US012590464B1

(12) United States Patent
Faris

(10) Patent No.: US 12,590,464 B1
(45) Date of Patent: Mar. 31, 2026

(54) SCAFFOLDING SUPPORT AND A SCAFFOLD ARRANGEMENT

(71) Applicant: Troy Faris, Hollywood, FL (US)

(72) Inventor: Troy Faris, Hollywood, FL (US)

( * ) Notice: Subject to any disclaimer, the term of this patent is extended or adjusted under 35 U.S.C. 154(b) by 417 days.

(21) Appl. No.: 18/115,319

(22) Filed: Feb. 28, 2023

Related U.S. Application Data

(60) Provisional application No. 63/315,116, filed on Mar. 1, 2022.

(51) Int. Cl.

| | |
|---|---|
| ***E04G 1/15*** | (2006.01) |
| ***E04G 5/04*** | (2006.01) |
| ***E04G 5/06*** | (2006.01) |
| ***E04G 5/08*** | (2006.01) |
| ***E04G 5/14*** | (2006.01) |
| ***E04G 7/28*** | (2006.01) |

(52) U.S. Cl.
CPC ..... *E04G 7/28* (2013.01); *E04G 1/15* (2013.01); *E04G 5/04* (2013.01); *E04G 5/046* (2013.01); *E04G 5/048* (2013.01); *E04G 5/06* (2013.01); *E04G 5/062* (2013.01); *E04G 5/067* (2013.01); *E04G 5/08* (2013.01); *E04G 5/14* (2013.01)

(58) Field of Classification Search
CPC .... E04G 7/28; E04G 1/15; E04G 5/04; E04G 5/046; E04G 5/048; E04G 5/06; E04G 5/062; E04G 5/067; E04G 5/08; E04G 5/14
See application file for complete search history.

(56) References Cited

U.S. PATENT DOCUMENTS 871,137 A * 11/1907 McIntyre ..... E04G 5/06 248/240.3
905,339 A * 12/1908 Mani ..... E04G 5/06 248/240.3
1,449,638 A * 3/1923 Trester ..... E04G 5/062 248/240.3
1,591,648 A * 7/1926 Sittig ..... E04G 5/062 248/235
1,636,185 A * 7/1927 Goodwin ..... E04G 5/06 248/245
1,748,207 A * 2/1930 Clough ..... E04G 5/062 248/236
1,820,330 A * 8/1931 Sittig ..... E04G 5/062 182/87
1,843,268 A * 2/1932 Burkholder ..... E04G 5/062 248/240.3
2,279,850 A 4/1942 Vansickle
2,332,477 A * 10/1943 Thornley ..... E04G 5/06 182/87
2,340,487 A * 2/1944 Paquette ..... E04G 5/06 248/245
2,577,979 A * 12/1951 Pierson ..... E04G 5/06 248/235

(Continued)

*Primary Examiner* — Robert Canfield
(74) *Attorney, Agent, or Firm* — John Rizvi; John Rizvi, P.A.—The Patent Professor ®

(57) ABSTRACT

A scaffolding support for forming a scaffold arrangement is described. The scaffolding support includes a first beam and a second beam. The second beam is angled with respect to the first beam. The scaffolding support further includes a frame holder for coupling with a frame member and a plank holder for coupling with a scaffolding plank. A corresponding scaffold arrangement is also provided.

17 Claims, 6 Drawing Sheets

(56) References Cited

U.S. PATENT DOCUMENTS 2,605,074 A * 7/1952 Bucsko ..... E04G 5/06 248/228.2
2,833,503 A * 5/1958 Harshbarger ..... E04G 5/06 182/113
2,957,670 A * 10/1960 Wendl ..... E04G 5/062 182/216
3,493,208 A * 2/1970 Sato ..... E04G 7/305 248/235
3,515,244 A * 6/1970 Weible ..... E04G 3/20 182/150
3,776,498 A 12/1973 Peters et al.
3,960,355 A * 6/1976 Prichard, Jr. ..... E04G 17/002 269/208
4,134,473 A * 1/1979 Prior ..... E04G 1/34 182/182.4
4,452,336 A * 6/1984 Sickler ..... E04G 5/04 248/216.1
4,673,060 A * 6/1987 Gregory ..... E04G 5/06 182/113
4,909,350 A 3/1990 Jacobs
5,156,235 A * 10/1992 Preston ..... E04G 5/12 248/235
5,257,766 A * 11/1993 Riblet ..... A61K 47/6845 248/248
5,316,253 A 5/1994 Flathau et al.
5,381,738 A * 1/1995 Meyer ..... A47B 5/00 108/42
5,503,358 A * 4/1996 Lapp ..... E04G 5/06 248/235
5,524,727 A * 6/1996 Yennie, Jr. ..... E04G 3/20 182/150
5,535,974 A 7/1996 Savitski
5,638,917 A * 6/1997 Vennen ..... E04G 3/20 182/113
5,771,991 A * 6/1998 Fresco ..... E04G 21/3214 248/235
6,003,630 A 12/1999 Whalen
6,955,242 B2 * 10/2005 Markovich ..... E04G 17/002 182/82
7,258,197 B1 8/2007 Wicks
7,264,083 B2 9/2007 Wilcox
7,360,627 B2 * 4/2008 Scott ..... A47B 96/061 182/150
7,748,195 B2 * 7/2010 Keith ..... E04G 5/04 182/87
8,061,665 B2 11/2011 Solis et al.
9,072,380 B2 * 7/2015 Durgin ..... A47B 96/07
D880,277 S 4/2020 Perry
12,049,764 B1 * 7/2024 Lyle, II ..... E04G 11/06
2001/0025741 A1 10/2001 Hudson
2002/0139614 A1 * 10/2002 Volkman ..... E04G 3/26 182/150
2004/0007423 A1 * 1/2004 Scott ..... A47B 96/061 182/113
2004/0020713 A1 * 2/2004 Fregosi ..... E04G 3/20 182/82
2006/0180392 A1 * 8/2006 Scharff ..... E04G 5/062 182/82
2006/0243523 A1 * 11/2006 Curtin ..... E04G 3/22 182/82
2006/0243524 A1 11/2006 Jarrell
2008/0202064 A1 * 8/2008 Keith ..... E04G 5/046 52/745.12
2008/0264725 A1 * 10/2008 Miles ..... E04G 5/14 182/113
2009/0200442 A1 * 8/2009 Solis ..... E04G 5/06 248/246
2010/0032235 A1 2/2010 Barendregt
2012/0247872 A1 * 10/2012 Liu ..... E04G 3/20 182/112
2018/0245356 A1 * 8/2018 Muth ..... E04G 3/20
2020/0080327 A1 3/2020 Burrow
2021/0095484 A1 4/2021 Moeggenborg

* cited by examiner

SCAFFOLDING SUPPORT AND A SCAFFOLD ARRANGEMENT

CROSS-REFERENCE TO RELATED APPLICATIONS

This application claims the benefit of U.S. Provisional Patent Application Ser. No. 63/315,116 filed on Mar. 1, 2022, which is incorporated by reference herein in its entirety.

FIELD OF THE INVENTION

The present invention relates generally to an apparatus for forming a scaffold, and more particularly to a scaffolding support for a securely supporting a scaffolding plank and providing a secure scaffold arrangement.

BACKGROUND OF THE INVENTION

Nowadays, as more and more construction activities take place, it becomes important for workers to be time-efficient and complete their tasks quickly without being injured. Almost all construction activities require scaffold arrangements for workers to access different areas of a particular construction site. Conventional scaffold arrangements are difficult to assemble and require a lot of time, leaving less time for carrying out the constructional activities. Further, conventional scaffold arrangements, when assembled, are not secure enough to prevent accidents and injuries.

Accordingly, there is an established need for a solution to the problems mentioned above. For instance, there is an established need for a scaffolding support that facilitates forming a scaffold arrangement in a quick manner. Further, there is an established need for a scaffolding support that facilitates forming a secure and durable scaffold arrangement. Further, there is an established need for a scaffolding support that facilitates a single user to assemble the scaffold arrangement.

SUMMARY OF THE INVENTION

The present invention relates to a scaffolding support to form a scaffold arrangement. The scaffolding support comprises a first beam and a second beam. The second beam is angled with respect to the first beam. The scaffolding support further comprises a frame holder and a plank holder. The frame holder is configured for coupling with a frame member and the plank holder is configured for coupling with a scaffolding plank.

In an aspect, the scaffolding support coupled to the frame member and the scaffolding plank by means of the frame holder and the plank holder respectively, form a part of the scaffold arrangement for use by a user.

In an aspect, the frame holder comprises at least one connector for facilitating coupling with the frame member.

In an aspect, the frame holder comprises a base portion, the at least one connector comprises a first connector provided at a lower portion of the base portion, a second connector provided at a central portion of the base portion, and a third connector provided at an upper portion of the base portion.

In an aspect, the first connector couples with the second beam, and the second connector couples with the first beam.

In an aspect, at least one of the first connector, the second connector, and the third connector comprises one or more pin holes to secure coupling between the frame holder and the frame member.

In an aspect, the plank holder comprises projections defining a slot for facilitating coupling with the scaffolding plank.

In an aspect, the plank holder further comprises an aperture to receive a spike nail or a pin to secure coupling between the plank holder and the scaffolding plank.

In an aspect, the scaffolding support further comprises a post configured for coupling to hand rails.

In an aspect, the post is detachably coupled to the plank bolder and/or the first and second beams.

In an aspect, the post comprises a rail receptacle for facilitating coupling with the hand rails.

In an aspect, the post coupled with the hand rails form a part of the scaffold arrangement.

In an aspect, the first beam and the second beam are connected at respective first ends of the first beam and the second beam.

In an aspect, the frame holder is coupled wot the first beam and the second beam at respective second ends of the first beam and the second beam.

In an aspect, the first beam extends at an angle of 45 degrees with respect to the second beam, wherein the frame holder extends substantially perpendicular to the first beam, and wherein the frame holder extends at an angle of 45 degrees with respect to the second beam.

The present invention further relates to a scaffold arrangement. The scaffold arrangement comprises a frame member; a scaffolding plank; and a scaffolding support. The scaffolding support comprises a first beam, and a second beam angled with respect to the first beam; a frame holder coupled with the frame member; and a plank holder coupled with the scaffolding plank.

In an aspect, the scaffold arrangement further comprises a post detachably coupled to one or more of the plank holder, the first beam, and the second beam; and one or more hand rails coupled to the post.

These and other objects, features, and advantages of the present invention will become more readily apparent from the attached drawings and the detailed description of the embodiments and examples, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
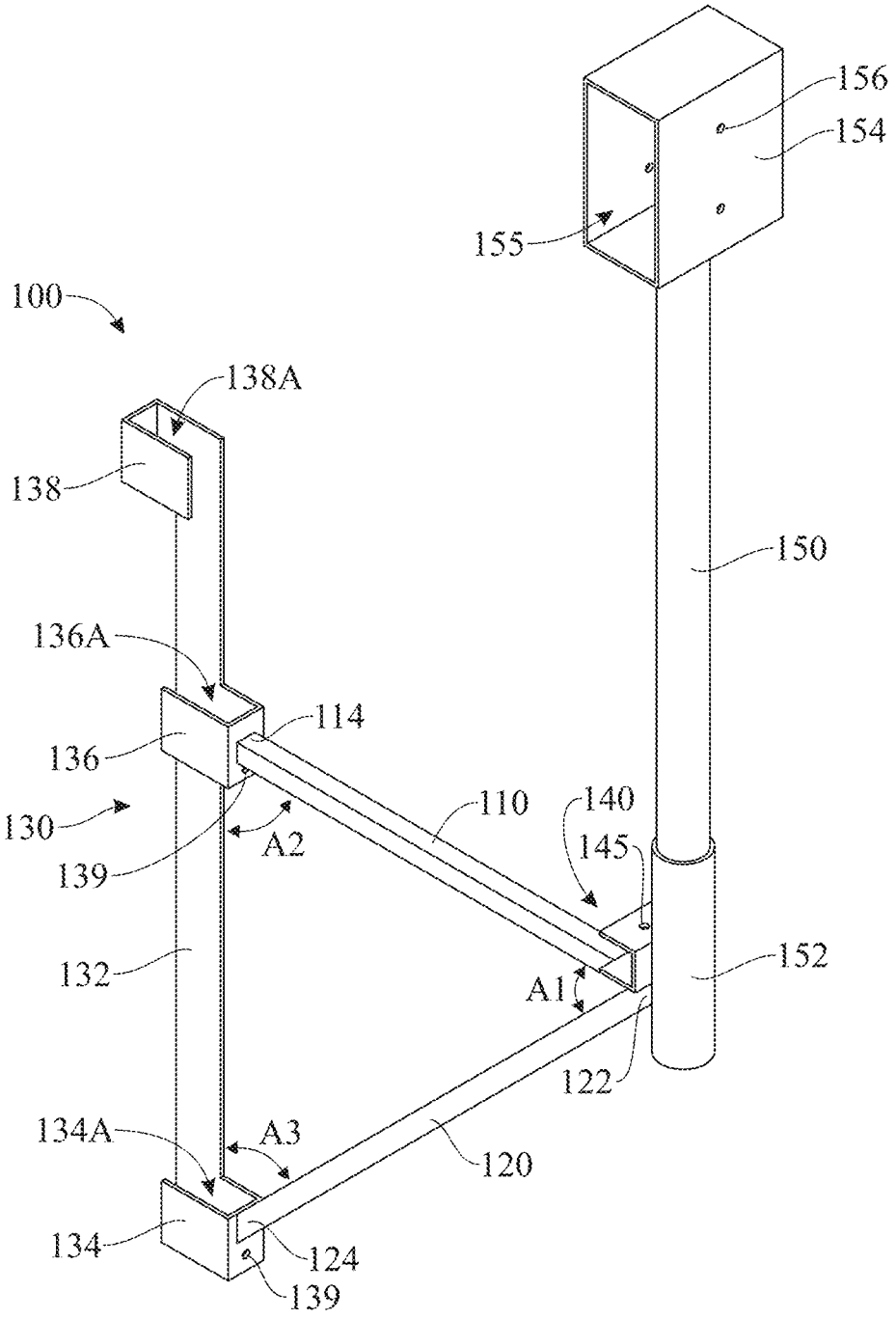
FIG. 1 illustrates a perspective view of a scaffolding support for forming a scaffold arrangement, in accordance with one embodiment of the present specification.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other embodiments. All of the embodiments described below are exemplary embodiments provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well-known elements associated with scaffolds have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

As used in this specification and the appended claims, the singular forms "a," "an," and "the" include plural referents unless the content clearly dictates otherwise, and the vice versa. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

Shown throughout the drawings, the present invention is directed toward a scaffolding support that is compact and sleek and provides a safe and durable manner for assembling a scaffold arrangement in a quick time, and in some cases, by a single user only.

Figure 2:
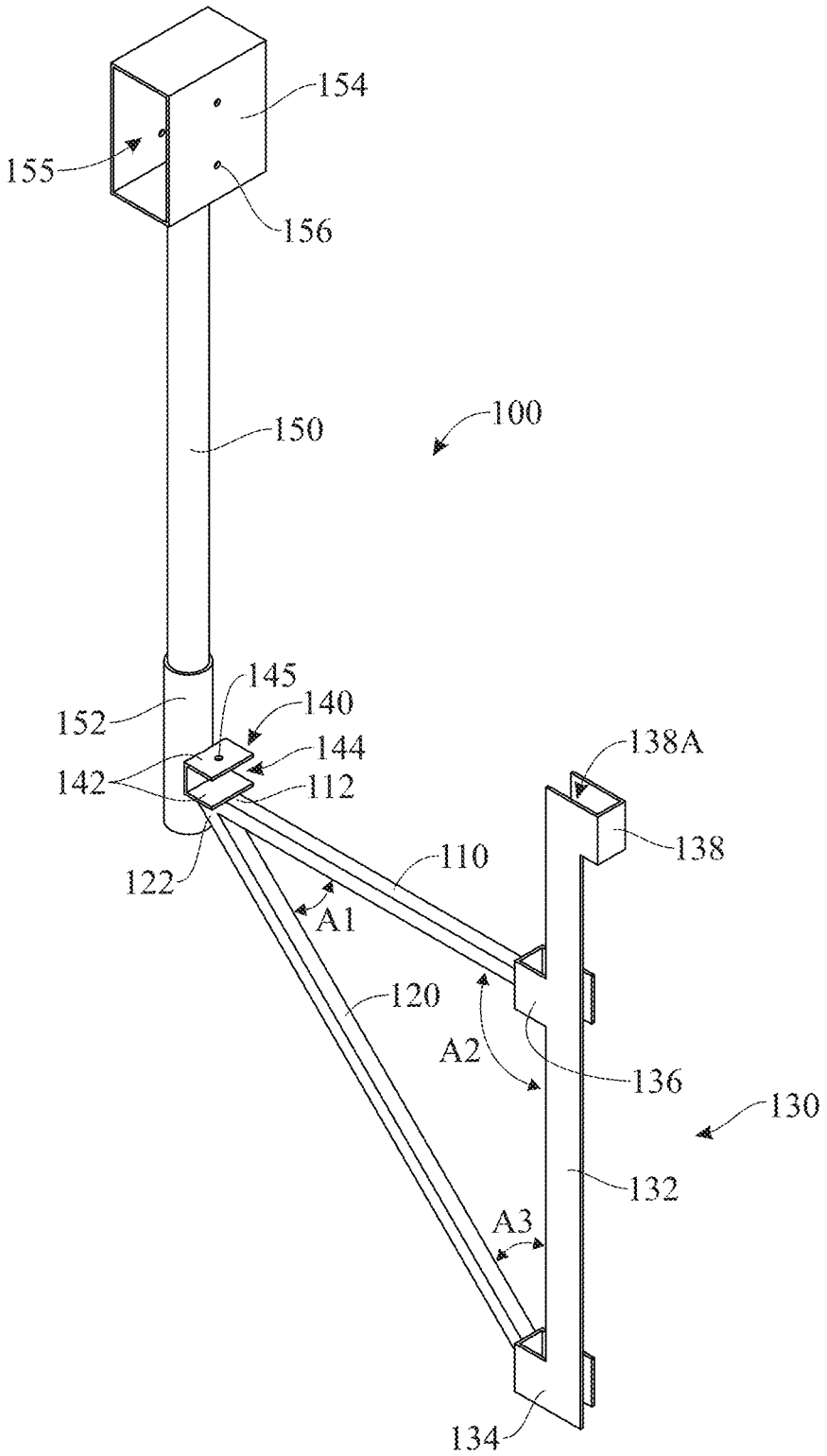
FIG. 2 illustrates another perspective view of the scaffolding support of FIG. 1, in accordance with one embodiment of the present specification.

Reference is initially made to FIGS. 1-2 which illustrate perspective views of a scaffolding support 100 in accordance with an embodiment of the present invention. The scaffolding support 100 forms a part of a scaffold arrangement for use during construction activities and facilitates forming the scaffold arrangement in a secure manner. The scaffolding support 100 increases efficiency and safety for multiple applications in the construction industry.

The scaffolding support 100 comprises a first beam 110 and a second beam 120 connected to each other. In the illustrated embodiment, the first beam 110 has a first end 112 while the second beam 120 has a first end 122, the first beam 110 and the second beam 120 being connected at the respective first ends 112, 122.

The second bean 120 is connected to the first beam 110 at the respective first ends 112, 122, however, the second beam 120 diverges from the first beam 110 thereafter. In other words, the second beam 120 is angled with respect to the first beam 110 and at the respective first ends 112, 122, the first beam 110 and the second beam 120 are connected at an angle A1. In an embodiment, the angle A1 is about 45 degrees. As used herein, the term "about" is intended to encompass deviations of + or −10 percent from the specifically mentioned value of a parameter. In an embodiment, the angle A1 is exactly 45 degrees.

In an embodiment, the first and second beams 110, 120 are made of steel (box steel configuration). In an embodiment, a width of the first and second beams 110, 120 is about 1 inch. In an embodiment, a length of the first beam 110 is about 26¼ inches. In an embodiment, a length of the second beam 120 is about 35½ inches.

The scaffolding support 100 further comprises a frame holder 130. The frame holder 130 is configured to be coupled to an existing frame member, such as a wooden frame, at a construction site where the scaffolding support 100 is being utilized. The first beam 110 comprises a second end 114 and the second beam 120 comprises a second end 124, each of the respective second ends 114, 124 being coupled to the frame holder 130.

The frame holder 130 extends at an angle with respect to the first beam 110 as well as the second beam 120. In an embodiment, the frame holder 130 extends substantially perpendicular to the first beam 110. In an embodiment, an angle A2 between the first beam 110 and the frame holder 130 is 90 degrees. In an embodiment, the frame holder 130 extends at an angle A3 with respect to the second beam 120. In an embodiment, the angle A3 is 45 degrees.

In an embodiment, the angles A1 and A3 are 45 degrees each and the angle A2 is 90 degrees, the respective angles between the first beam 110, the second beam 120, and the frame holder 130 causing the scaffolding support 100 to assume a triangular configuration. The triangular configuration allows the scaffolding support 100 to be coupled directly to an existing frame member at a construction site in an efficient and secure manner. Further, the scaffolding support 100 allows a user, for instance a construction worker, to assemble scaffold arrangement quickly, thereby saving substantial time and increasing the speed of construction work.

The frame holder 130 comprises a base portion 132 extending at an angle with respect to the first beam 110 and the second beam 120. The frame holder 130 further comprises multiple connectors extending from the base portion 132, the connectors being configured to engage with an existing frame member, such as a wooden frame member, in order to attach the frame holder 130, and consequently the scaffolding support 100, to the existing frame member.

The frame holder 130 comprises a first connector 134 provided at a lower portion of the base portion 132. The first connector 134 has a three-walled configuration so as to assume a U-shape. The first connector 134 is coupled to the second beam 120, in particular to the second end 124 of the second beam 120. The first connector 134 defines a connecting space 134A which allows the first connector 134 to engage with a frame member.

The frame holder 130 further comprises a second connector 136 provided at a central portion of the base portion 132. The second connector 136 may be provided vertically above the first connector 134. The second connector 136 is similar in configuration to the first connector 134, in that, the second connector 136 has a three walled configuration and assumes a U-shape. The second connector 136 is coupled to the first beam 110, in particular to the second end 114 of the first beam 110. Similar to the first connector 134, the second connector 136 defines a connecting space 136A which allows the second connector 136 to engage with a frame member.

The frame holder 130 further comprises a third connector 138 provided at an upper portion of the base portion 132. The third connector 138 may be provided vertically above the first connector 134 and the second connector 136. The third connector 138 has a three-walled configuration, however, the third connector 138 assumes an inverted U-shape. The third connector 138 defines a connecting space 138A which allows the third connector 138 to engage with a frame member.

In an embodiment, at least one of the first connector 134, the second connector 136, and the third connector 138 comprise pin hole(s) 139 that allow hardened pins to be inserted therein for a more secure connection with an existing frame member, and further, allowing a self-locking arrangement which can be easily installed by a single user.

In an embodiment, a length of the frame holder 130 is about 39 inches. In an embodiment, each of the first, second, and third connectors 134, 136, 138 have a length of about 3 inches and a width of about 3¾ inches. In an embodiment, the base portion 132 is made of steel (flat steel configuration) and has a width of about 2 inches.

By virtue of the arrangement of the first beam 110, the second beam 120, and the frame holder 130 connected to the first beam 110 and the second beam 120, the scaffolding support 100 can be securely and efficiently coupled to an existing frame member. This allows a user at the construction site to quickly mount scaffolding planks to the scaffolding support 100 so as to form scaffolding for use during construction work.

In order to facilitate a user to mount scaffolding planks, the scaffolding support 100 comprises a plank holder 140. The plank holder 140 is provided adjacent the respective first ends 112, 122 of the first beam 110 and the second beam 120. In an embodiment, the plank holder 140 is provided atop the first end of the first beam 110. In an embodiment, the plank holder 140 is welded to the first end 112 of the first beam 110.

The plank holder 140 comprises a pair of projections 142 defining a slot 144 there-between. The projections 142 are horizontal projections defining a horizontal slot 144. This allows a scaffolding plank to be securely connected to the scaffolding support 100 by a portion thereof being inserted via the slot 144 of the plank holder 140 and being retained therein. The scaffolding plank would thus be retained securely in place by the plank holder 140, and further, the scaffolding plank may rest on the first beam 110 which would support the weight of the scaffolding plank.

In an embodiment, the plank holder 140 comprises an aperture 145 which allows a user to insert a spike nail or a pin there-through in order to more securely couple the scaffolding plank to the plank holder 140, and consequently to the scaffolding support 100. In an embodiment, a length of the plank holder 140 is about 2 inches. In an embodiment, the slot 144 has a length of about 1⅝ inches.

The scaffolding support 100 further comprises a post 150 configured to support hand rails for additional safety. The post 150 may be connected to the plank holder 140 and the first beam 110 and the second beam 120 by means of a post holder 152. The post holder 152 is connected to a rear surface of the plank holder 140. The post holder 152 may additionally be connected to the first beam 110 and the second beam 120. In an embodiment, the post holder 152 is permanently connected to the plank holder 140, such as by welding.

The post 150 is detachably connected to the plank holder 140 by means of the post holder 152, thus allowing the post 150 to be used whenever hand rails are required for additional safety. In other words, the post 150 can be inserted in the post holder 152 whenever hand rails are required for additional safety. Post such use, or in case hand rails are not required, the post 150 can be removed from the post holder 152.

The post 150 comprises a rail receptacle 154 configured to receive and retain hand rails. The rail receptacle 154 takes the configuration of a hollow box having a through-hole 155 allowing hand rails to pass through the through-hole 155. Thus, a user can pass hand rails through the through-hole 155, thereby allowing the post 150 to retain the hand rails for additional safety. The rail receptacle 154 may include openings 156 that allows nails or pins to pass there-through and securely fix the hand rails with the rail receptacle 154, and consequently, the post 150.

In an embodiment, the post 150 has a length of about 24 inches (from the post holder 152 till the rail receptacle 154) and a diameter of about 1 inch. In an embodiment, the rail receptacle 154 has a length of about 6 inches. In an embodiment, the through-hole 155 has a length of about 5% inches and a width of about 1⅝ inches. In an embodiment, the post holder 152 has a diameter of about 3 inches.

Figure 3:
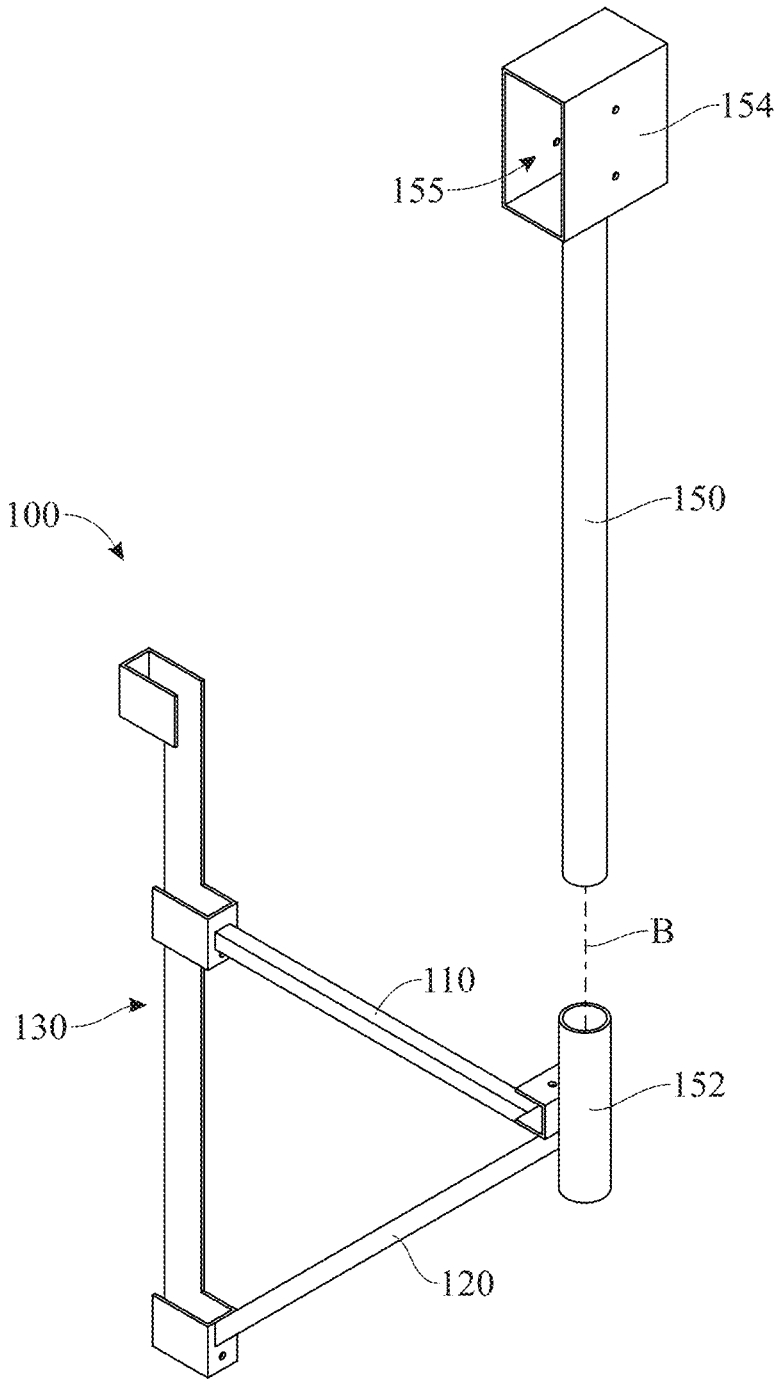
FIG. 3 illustrates a perspective view of the scaffolding support with a post being inserted into a post holder, in accordance with one embodiment of the present specification.
Figure 4:
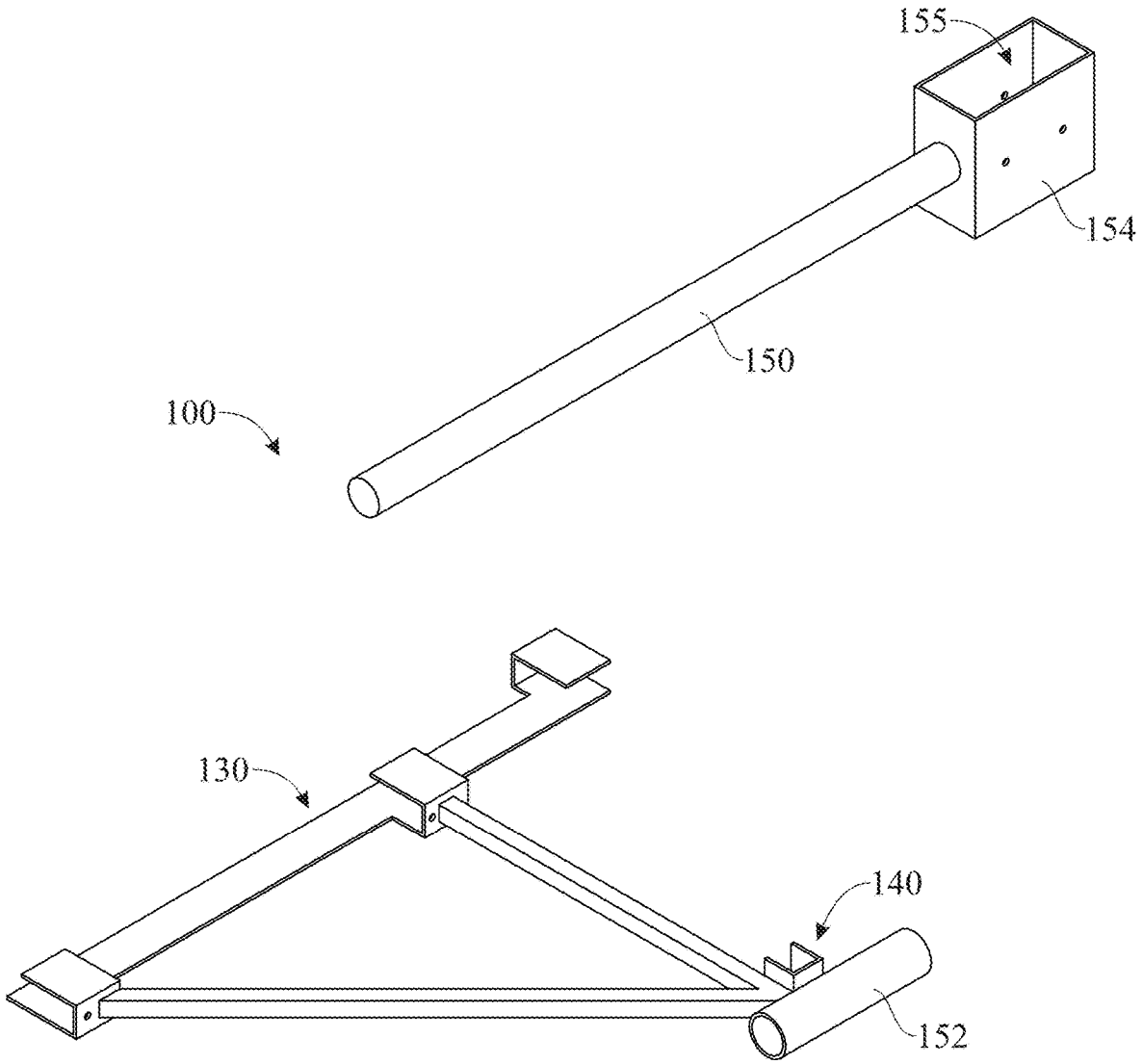
FIG. 4 illustrates a perspective view of the scaffolding support with the post being detached from the scaffolding support, in accordance with one embodiment of the present specification.

Reference is now made to FIG. 3, which illustrates a perspective view of the post 150 being inserted into the post holder 152 and FIG. 4, which illustrates the post 150 detached from the post holder 152. The scaffolding support 100 can be used without the post 150 to form a scaffold arrangement by assembling mounting planks on the scaffolding support 100. In case use of additional hand rails are required, for instance, when additional safety is desired in complex constructional work, the post 150 can be attached to the scaffolding support 100.

As can be seen in FIG. 3, the post 150 having the rail receptacle 154 can be inserted into the post holder 152 along the line B, thereby attaching the post 150 to the scaffolding support 100. The post holder 152 securely holds the post 150 in place during use of the scaffolding support 100. In an embodiment, additional securing means can be provided at the post holder 152 and/or the post 150 to obtain a more secure attachment of the post 150 to the scaffolding support 100 via the post holder 152.

After the use of the post 150, when it is desired to remove the post 150 from the post holder 152, the post 150 can be taken out from the post holder 152 along the line B. FIG. 4 illustrates the post 150 detached from the post holder 152, and thus, detached from the scaffolding support 100. In such a scenario, the scaffolding support 100 can still be used to hold scaffolding planks.

Figure 5:
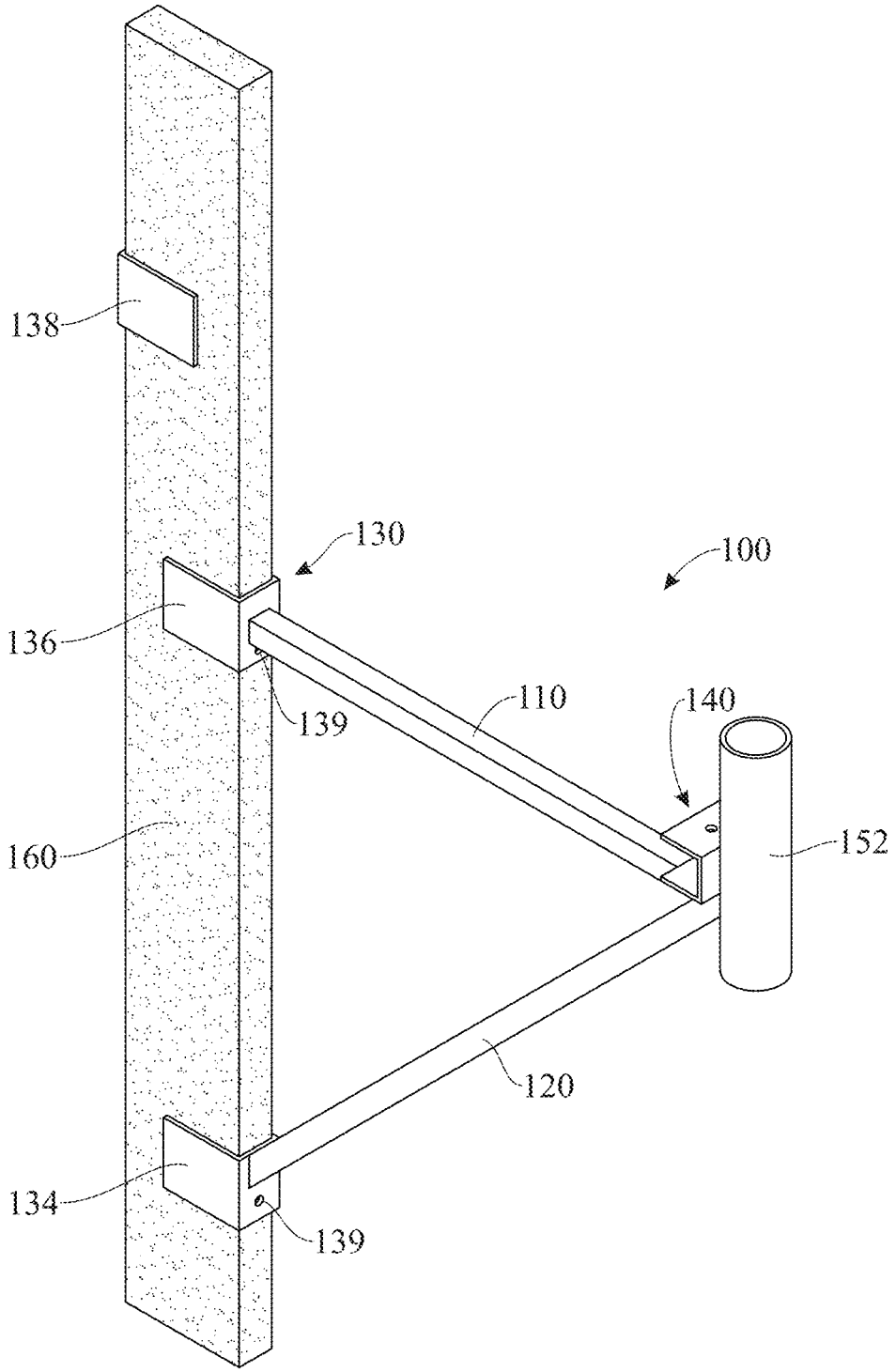
FIG. 5 illustrates a perspective view of the scaffolding support coupled to a wooden frame member, in accordance with one embodiment of the present specification.

Reference is now made to FIG. 5 that illustrates the scaffolding support 100 coupled to a wooden frame member 160. The frame holder 130 of the scaffolding support 100 facilitates coupling of the wooden frame member 160 to the scaffolding support 100. The frame holder 130 engages with the wooden frame member 160 via the first, second, and third connectors 134, 136, 138. In an embodiment, the wooden frame member can be a 2×6 inches or a 2×4 inches frame member.

As seen in FIG. 5, the first connector 134 attached to the second beam 120 and the second connector 136 attached to the first beam 110 engage the wooden frame member 160 from one side thereof. The third connector 138 at an tipper portion of the base portion 132 (not visible in FIG. 5) engages the wooden frame member 160 from an opposite side thereof, thereby allowing the frame holder 130, and thus the scaffolding support 100, to securely hold the wooden frame member 160.

In an embodiment, users can more securely establish coupling between the wooden frame member 160 and the scaffolding support 100 by means of the pin holes 139 provided in at least the first connector 134 and the second connector 136. In an embodiment, each of the first, second, and third connectors 134, 136, 138 include pin holes 139. The pin holes 139 allow users to insert hardened pins through the respective connectors and into the wooden frame member 160, thus establishing a more secure connection of the scaffolding support 100 with the wooden frame member 160, and further, allowing a self-locking arrangement which can be easily installed by a single user.

Figure 6:
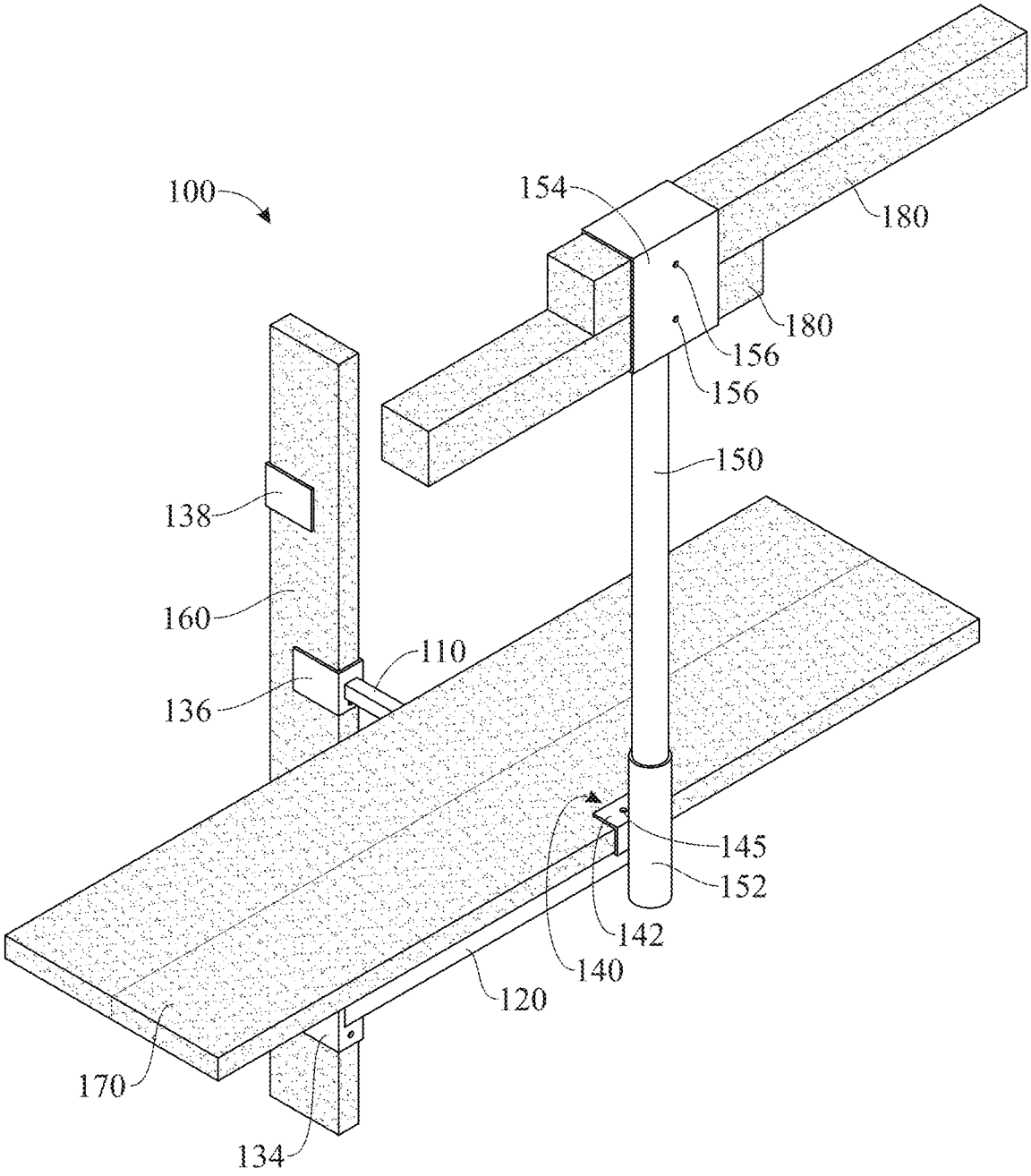
FIG. 6 illustrates a perspective view of the scaffolding support coupled to a wooden frame member, scaffolding plank, and hand rails so as to form a scaffold arrangement, in accordance with one embodiment of the present specification.

Reference is now made to FIG. 6 which illustrates the scaffolding support 100 coupled to a wooden frame member 160, scaffolding plank 170, and hand rails 180 so as to form a scaffold arrangement. The wooden frame member 160 is coupled to the scaffolding support 100 by means of the first, second, and third connectors 134, 136, 138, as has been described with reference to FIG. 5.

The scaffolding support 100 securely holds the scaffolding plank 170 by means of the plank holder 140, in that, the plank holder 140 comprises projections 142 (only 1 visible in FIG. 6) defining a slot 144 (not visible in FIG. 6) that receives at least some portion of the scaffolding plank 170. The scaffolding plank 10 is supported by at least the first beam 110 as well. The scaffolding plank 170 supports the weight of one or more users and provides a surface for a user to stand, place their tools, and carry out their activities.

In an embodiment, the scaffolding plank 170 can more securely be engaged with the plank holder 140 by means of aperture 145, in that, the aperture 145 allows a user to insert a spike nail or a pin there-through and into the scaffolding plank 170. In practice, a user can simply insert the scaffolding plank 170 into the plank holder 140, and then insert a spike nail or a pin through the aperture 145, leading to a secure engagement of the scaffolding plank 170 with the scaffolding support 100.

The scaffolding support 100 further holds the hand rails 180 by means of the post 150, and in particular, the rail receptacle 154 of the post 150. The hand rails 180 can be used whenever additional safety is desired. The hand rails can be made to pass through the rail receptacle 154 that retains the hand rails 180 there-within.

In an embodiment, the hand rails 180 can be more securely retained by the rail receptacle 154 of the post 150 by means of openings 156, in that, the openings 156 allows a user to insert nails or pins there-through and into the hand rails 180. In practice, a user can simply insert the hand rails 180 through the rail receptacle 154, and then insert nails or pins through the openings 156, leading to a secure engagement of the hand rails 180 with the scaffolding support 100.

As seen in FIG. 6, the wooden frame member 160, the scaffolding plank 170, and the hand rails 180 are securely coupled to the scaffolding support 100, thus forming a scaffold arrangement that can be assembled quickly and easily by users and can be used in constructional activities. In an embodiment, the hand rails 180 and the post 150 are optional, and the scaffold arrangement can be formed by the wooden frame member 160 and the scaffolding plank 170 securely coupled to the scaffolding support 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A scaffolding support to form a scaffold arrangement, the scaffolding support comprising:

a first beam, and a second beam angled with respect to the first beam;

a frame holder to couple with a frame member, wherein the frame holder comprises:

a base portion, a first connector provided at a lower portion of the base portion, the first connector having a three-walled configuration to assume a U-shape defining a connecting space to engage a portion of the frame member from a first side of the frame member, a second connector provided at a central portion of the base portion vertically above the first connector, the second connector having a three-walled configuration to assume a U-shape defining a connecting space to engage another portion of the frame member from said first side of the frame member, and a third connector provided at an upper portion of the base portion vertically above the first connector and the second connector, the second connector having a three-walled configuration to assume an inverted U-shape defining a connecting space to engage another portion of the frame member from an opposite, second side of the frame member; and a plank holder to couple with a scaffolding plank.

2. The scaffolding support of claim 1, wherein the first beam and the second beam are connected at respective first ends of the first beam and the second beam.

3. The scaffolding support of claim 2, wherein the frame holder is coupled to the first beam and the second beam at respective second ends of the first beam and the second beam.

4. The scaffolding support of claim 1, wherein the first beam extends at an angle of 45 degrees with respect to the second beam, wherein the frame holder extends substantially perpendicular to the first beam, and wherein the frame holder extends at an angle of 45 degrees with respect to the second beam.

5. The scaffolding support of claim 1, wherein the first connector couples with the second beam, and the second connector couples with the first beam.

6. The scaffolding support of claim 1, wherein at least one of the first connector, the second connector, and the third connector comprises one or more pin holes to secure coupling between the frame holder and the frame member.

7. The scaffolding support of claim 1, wherein the plank holder comprises projections defining a slot to facilitate coupling between the plank holder and the scaffolding plank.

8. The scaffolding support of claim 1, further comprising a post to support one or more hand rails.

9. The scaffolding support of claim 8, wherein the post is detachably coupled to one or more of the plank holder, the first beam, and the second beam.

10. The scaffolding support of claim 8, wherein the post comprises a rail receptacle to receive and retain the one or more hand rails.

11. A scaffold arrangement, comprising:

a frame member;

a scaffolding plank; and a scaffolding support, comprising:

a first beam, and a second beam angled with respect to the first beam;

a frame holder coupled with the frame member, the frame holder comprising:

a base portion, a first connector provided at a lower portion of the base portion, the first connector having a three-walled configuration to assume a U-shape defining a connecting space to engage a portion of the frame member from a first side of the frame member, a second connector provided at a central portion of the base portion vertically above the first connector, the second connector having a three-walled configuration to assume a U-shape defining a connecting space to engage another portion of the frame member from said first side of the frame member, and a third connector provided at an upper portion of the base portion vertically above the first connector and the second connector, the second connector having a three-walled configuration to assume an inverted U-shape defining a connecting space to engage another portion of the frame member from an opposite, second side of the frame member; and a plank holder coupled with the scaffolding plank.

12. The scaffold arrangement of claim 11, further comprising:

a post detachably coupled to one or more of the plank holder, the first beam, and the second beam; and one or more hand rails coupled to the post.

13. The scaffold arrangement of claim 12, wherein the post comprises a rail receptacle to receive and retain the one or more hand rails.

14. The scaffold arrangement of claim 11, wherein at least one of the first connector, the second connector, and the third connector comprises one or more pin holes to secure coupling between the frame holder and the frame member.

15. The scaffold arrangement of claim 11, wherein the plank holder comprises projections defining a slot to facilitate coupling between the plank holder and the scaffolding plank.

16. The scaffold arrangement of claim 15, wherein the plank holder further comprises an aperture to receive a spike nail or a pin to secure coupling between the plank holder and the scaffolding plank.

17. The scaffold arrangement of claim 11, wherein the first beam extends at an angle of 45 degrees with respect to the second beam, wherein the frame holder extends substantially perpendicular to the first beam, and wherein the frame holder extends at an angle of 45 degrees with respect to the second beam.

* * * * *